US005591018A

United States Patent [19]

Takeuchi et al.

[11] Patent Number: 5,591,018

[45] Date of Patent: Jan. 7, 1997

[54] HERMETIC SCROLL COMPRESSOR HAVING A PUMPED FLUID MOTOR COOLING MEANS AND AN OIL COLLECTION PAN

[75] Inventors: Yoshiharu Takeuchi, Otsu; Toshiharu Yasu, Yasu-gun; Manabu Sakai; Masahiro Tsubokawa, both of Kusatsu; Hideto Oka, Kouga-gun; Osamu Aiba, Kusatsu, all of Japan

[73] Assignee: Matsushita Electric Industrial Co., Ltd., Osaka, Japan

[21] Appl. No.: 364,884

[22] Filed: Dec. 27, 1994

[30] Foreign Application Priority Data

Dec. 28, 1993 [JP] Japan ..... 5-337802
Dec. 28, 1993 [JP] Japan ..... 5-337808

[51] Int. Cl.[6] ..... F04B 39/06

[52] U.S. Cl. ..... 417/366; 417/372; 417/902; 418/55.6; 418/94; 184/6.18; 184/65

[58] Field of Search ..... 417/366, 372, 417/902, 410.5; 418/55.6, 94; 184/6.18, 65

[56] References Cited

U.S. PATENT DOCUMENTS

| | | | |
|---|---|---|---|
| 3,396,907 | 8/1968 | Valbjorn | 417/902 |
| 4,343,599 | 8/1982 | Kousokabe | 418/55.6 |
| 4,518,324 | 5/1985 | Mizuno et al. | 417/366 |
| 4,666,381 | 5/1987 | Butterworth | 418/94 |

FOREIGN PATENT DOCUMENTS

| | | | |
|---|---|---|---|
| 18286 | 1/1984 | Japan | 417/366 |
| 217349 | 4/1987 | Japan | 418/94 |
| 106392 | 5/1988 | Japan | 418/55.6 |
| 181084 | 7/1990 | Japan | 418/55.6 |
| 230993 | 9/1990 | Japan | 418/55.6 |
| 5164069 | 6/1993 | Japan | 417/366 |
| 5288182 | 11/1993 | Japan | 417/902 |
| 18287 | 1/1994 | Japan | 418/94 |

*Primary Examiner*—Timothy S. Thorpe
*Assistant Examiner*—Roland G. McAndrews, Jr.
*Attorney, Agent, or Firm*—Panitch Schwarze Jacobs & Nadel, P.C.

[57] ABSTRACT

In a sealed electric scroll compressor, lubricating oil is collected in an oil collection pan mounted under a compression mechanism after the compression mechanism is lubricated thereby, the lubricating oil collected in the oil collection pan is discharged from a small hole at the side of the oil collection pan which is located remote from a delivery pipe for delivering a high-pressure refrigerant gas outward from a sealed container of the sealed electric compressor. The high-pressure refrigerant gas flows between the inner wall of the sealed container and a vertical cut part formed on the circumference of a stator of an electric motor.

13 Claims, 12 Drawing Sheets

HERMETIC SCROLL COMPRESSOR HAVING A PUMPED FLUID MOTOR COOLING MEANS AND AN OIL COLLECTION PAN

FIELD OF THE INVENTION AND RELATED ART STATEMENT

1. Field of the Invention

The present invention relates to a sealed electric compressor such as a scroll compressor or a rotary compressor which is to be used for an air conditioner and a refrigerator.

2. Description of the Related Art

Hitherto, a sealed electric compressor such as a scroll compressor or a rotary compressor is used for a refrigerating device of an air conditioner and a refrigerator.

The prior art of the sealed electric compressor of this type is disclosed in the Japanese published unexamined patent application Sho 60-50996, and is described with reference to figures.

As shown in FIG. 10, a sealed container 101 includes a compression mechanism 102, an electric motor 103 comprising a rotor 104 and a stator 105, a crank shaft 106 which transmits a torque of the electric motor 103 to the compression mechanism 102, and a bearing member 107 supporting the crank shaft 106. Moreover, the sealed container 101 is provided with a suction pipe 108 for sucking low pressure refrigerant gas and a delivery pipe 109 for delivering outward high pressure refrigerant gas compressed by the compression mechanism 102.

The torque of the electric motor 103 is transmitted to the compression mechanism 102 through the crank shaft 106 by rotation of the rotor 104 thereof, and the low pressure refrigerant gas sucked through the suction pipe 108 is compressed by the compression mechanism 102. High pressure refrigerant gas compressed by the compression mechanism 102 is discharged to a delivery chamber 113 of the sealed container 101 from an outlet 120. The high-pressure refrigerant gas flows in an electric motor chamber 114 enclosing the electric motor 103 through a communication hole 111 formed on the bearing member 107. Then, the high-pressure refrigerant gas flows mainly between the bearing member 107 and the electric motor 103 as shown by arrows and is delivered to a refrigerating system (not shown) through the delivery pipe 109.

An oil receiver 110 is formed at the bottom of the sealed container 101. Lubricating oil in the oil receiver 110 is pumped up by a lubricating oil pump (not shown) and is supplied to the compression mechanism 102 and sliding surfaces between the bearing member 107 and the crank shaft 106. A part of the lubricating oil is discharged from the compression mechanism 102 to the inner space of the sealed container 101 together with the high-pressure refrigerant gas. The rest of the lubricating oil falls from the bearing member 107 by gravitation and returns to the oil receiver 110.

FIG. 11 is a partially schematic horizontal section of FIG. 10 taken along the broken line D—D. As shown in FIG. 11, lead wires 115 of the stator 105 of the electric motor 103 are inserted in a slot 117 formed on a side wall of the bearing member 107. The ends 115A of the lead wires 115 are connected to a sealed terminal 116 arranged at an upper part of the sealed container 101 as shown in FIG. 10.

In the sealed electric compressor as mentioned above, the high pressure refrigerant gas which is compressed by the compression mechanism 102 and is discharged to the interior of the sealed container 101 passes mainly through a space between the bearing member 107 and the electric motor 103, and is delivered outwards from the sealed container 101 through the delivery pipe 109. Only a part of the high-pressure refrigerant gas shown by arrows 121 and 122 flows near the electric motor 103 and cools the stator 105. Therefore, the electric motor 103 is not sufficiently cooled by the high-pressure refrigerant gas. Particularly, when the electric compressor is operated at a high rotation speed or under a high load for a long time, a large current is sent to the stator winding 105 of the electric motor 103, and thus the stator winding 105 is severely heated owing to a resistance of a winding of the stator 105. Consequently, an insulation member (not shown) covering the winding of the stator 105 is deteriorated, and the stator 105 is liable to be broken. Finally, the electric compressor is liable to be broken.

Furthermore, since the high-pressure refrigerant gas is discharged to the inner space of the sealed container 101 and passes between the bearing member 107 and the electric motor 103, the path of the high-pressure refrigerant gas crosses the path of the lubricating oil dripping from the bearing member 107. Consequently, a lot of the lubricating oil dripped from the bearing member 107 is captured by the stream of the high-pressure refrigerant gas and is delivered outward the sealed container 101 through the delivery pipe 109. Particularly, when the electric compressor is operated at the high rotating speed and a discharge amount of the high-pressure refrigerant gas is increased, a weight ratio of the lubricating oil to the refrigerant gas greatly increases. Consequently, a pressure loss in a conduit system of a refrigerating cycle increases owing to the increase of the amount of discharge of the lubricating oil from the compression apparatus to the refrigerating cycle. Moreover, in such case owing to resultant lowering of heat conversion efficiencies in a condenser, an evaporator and a heat exchanger, cooling ability of the compression apparatus does not increase even if the compression mechanism is operated at the high rotating speed, and thus a coefficient of performance of the refrigerant cycle decreases.

Furthermore, in the above-mentioned compression apparatus of the prior art, in the event that the lead wires 115 contact the inner wall of the sealed container 101 while the compression apparatus is assembled, the covering material of the lead wires is heated in a welding process of the sealed container 101 and is deteriorated. In a worst case, the covering material is melted and the compression apparatus is liable to be defective before use due to short circuit of the lead wires.

OBJECT AND SUMMARY OF THE INVENTION

An object of the present invention is to provide an electric compressor having a high reliability and a high coefficient of performance by sufficiently cooling the stator of an electric motor by high-pressure refrigerant gas in the event that the temperature of the stator rises in operation at a high rotating speed or under a high load, and to reduce an amount of lubricating oil which is discharged from the electric compressor to a refrigerating cycle.

Another object of the present invention is to provide an electric compressor having a higher reliability by fixing and protecting the lead wires of the stator of the electric motor.

A compressor in accordance with the present invention comprises:

compression means disposed in a sealed container for compressing gas, intake means for taking the gas into the compression means, an electric motor disposed in the sealed container for driving the compression means, a crank shaft disposed in the sealed container for transmitting a driving torque of the electric motor to the compression means, discharge means disposed at a part of the compression means for passing the gas out of the sealed container, an oil collection pan disposed on a bearing for supporting the crank shaft for temporarily collecting lubricating oil after lubrication of the compression means and the crank shaft, and an oil passage means provided in the compression means for passing oil of the oil pan therefrom.

In another aspect, a compressor in accordance with the present invention comprises:

a compression means disposed in a sealed container for compressing gas, intake means for taking the gas into the compression means, an electric motor disposed in the sealed container for driving the compression means, a crank shaft disposed in the sealed container for transmitting a driving torque of the electric motor to the compression means, discharge means disposed at a part of the compression mechanism for passing the gas out of the sealed container, an oil collecting pan disposed on a bearing for supporting the crank shaft for temporarily collecting lubricating oil after lubrication of the compression means and the crank shaft, and oil passage means disposed on a circumference of the oil pan for passing and discharging collected oil of the oil pan.

In still another aspect, a compressor in accordance with the present invention comprises:

a compression means disposed in a sealed container for compressing gas, intake means for taking the gas into the compression means, an electric motor disposed in a motor chamber of the sealed container, and having a stator and a rotor for driving the compression means, a crank shaft disposed in the sealed container for transmitting a driving torque of the electric motor to the compression means, discharge means for passing gas out of the sealed container, disposed at a lower part of the compression means, an oil collection pan disposed on a lower part of the compression means for temporarily collecting lubricating oil after lubrication of the compression means and the crank shaft, and a tube mounted on the oil collection pan for passing and discharging the collected lubrication oil in the sealed container.

In still another aspect, a sealed electric compressor in accordance with the present invention comprises:

a compression mechanism disposed in a sealed container for compressing refrigerant gas, refrigerant gas intake means for taking the refrigerant gas into the compression means, an electric motor disposed in the sealed container for driving the compression mechanism, a crank shaft having a communication hole along the axis thereof and disposed in the sealed container for transmitting a driving torque of the electric motor to the compression mechanism, a lubricating oil receiver disposed on a lower part of the sealed container, and an oil collection pan having at least one small hole and disposed between the compression mechanism and the electric motor for temporarily collecting lubricating oil after slide parts of the compression mechanism are lubricated by supplying the lubricating oil of the lubricating oil receiver through the communication hole of the crank shaft, an interior space of the sealed container being divided into an electric motor chamber containing the electric motor and a delivery outlet chamber having a discharge outlet of the compression mechanism by the compression mechanism, and a hole through which the compression mechanism having a communicate high-pressure refrigerant gas discharged from the discharge outlet to the delivery chamber passes for communicating between the delivery outlet chamber and the electric motor chamber, a main stream of the high-pressure refrigerant gas after discharge from a communication hole 21A flowing down in a first vertical path defined between the inner wall of the sealed container and a vertical cut part formed along the substantially the same vertical axis as the axis of the communication hole on a circumference of a stator of the electric motor, and after passing down of the main stream to the part under the stator the main stream passing upwards through a gap between the stator and a rotor and other vertical path(s) defined between the inner wall of the 10 and other vertical cut part(s) on the circumference of the stator, and the main steam being delivered out of the sealed container from a delivery pipe positioned at substantially 180 degrees of central angle of the rotation axis of the crank shaft to the small hole.

In a further aspect, a sealed electric compressor in accordance with the present invention comprises:

a compression mechanism disposed n a sealed container for compressing refrigerant gas, intake means for taking the refrigerant gas into the compression mechanism, an electric motor disposed in the sealed container for driving the compression mechanism, a crank shaft disposed in the sealed container for transmitting a driving torque of the electric motor to the compression mechanism, a lubricating oil receiver disposed on a lower part of the sealed container, an oil collection pan having at least one small hole and disposed between the compression mechanism and the electric motor for temporarily collecting lubricating oil after slide parts of the compression mechanism are lubricated by supplying the lubricating oil of the lubricating oil receiver through the communication hole of the crank shaft, an interior space of the sealed container is partitioned into an electric motor chamber containing the electric motor and a delivery chamber having a discharge outlet of the compression mechanism by the compression mechanism, and a communication hole for communicating between the electric motor chamber and the delivery chamber is formed on the compression mechanism, and the communication hole is positioned at the substantially same radial direction as the central angle of the small hole disposed on the oil pan with respect to the rotation axis of the crank shaft.

In still further aspect, a compressor in accordance with the present invention comprises;

compression means enclosed in a sealed container, an electric motor for driving the compression means, disposed in the sealed container, a crank shaft for transmitting a torque of the electric motor to the compression means, disposed in the sealed container, a sealed terminal for supplying an electric power to the electric motor through lead wires communicated to the sealed terminal, disposed on the wall of the sealed container adjacent to the compression mechanism, and a cavity for inserting lead wires of the electric motor formed on the circumference of the compression mechanism, so that the cavity is formed from the circumference of the compression mechanism to the direction of the central axis thereof, and subsequently is bent along the circumference.

According to the present invention, the amount of the lubricating oil included in the high-pressure refrigerant gas and delivered outward is greatly reduced. Consequently, the pressure loss in a conduit system of the refrigerant cycle can be reduced, and deterioration of a heat conversion efficiency is prevented in a condenser, an evaporator and a heat exchanger. Moreover, since the stator of the electric motor is sufficiently cooled by the refrigerant gas, a temperature rise of the stator of the electric motor can be prevented in the operation at the high rotating speed or under the high load of the compressor. Moreover, since the lead wires of the stator are not heated in the welding process of the sealed container, the malfunction of the compressor due to deterioration of covered material of the lead wires or short circuit of the lead wires is prevented because melt of the covered material is prevented. Consequently, the compressor having a high reliability and a high coefficient of performance can be provided.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DESCRIPTION OF THE PREFERRED EMBODIMENT

[First embodiment]

The sealed electric compressor of the first embodiment of the present invention is described by taking an example of a sealed electric scroll compressor.

Figure 1:
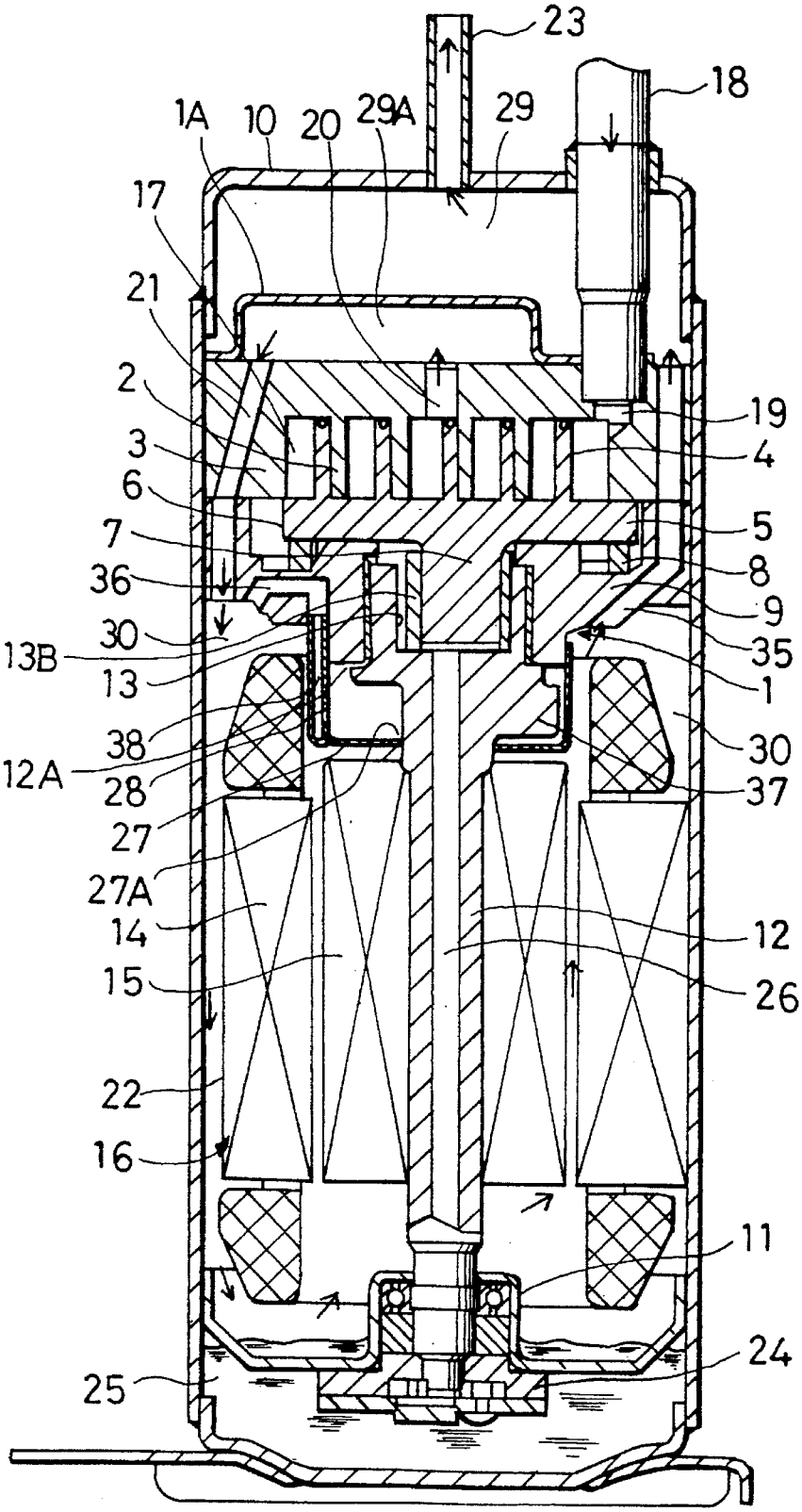
FIG. 1 is a cross-sectional side view of a sealed electric scroll compressor in a first embodiment of the present invention.

FIG. 1 is a cross-sectional side view of the sealed electric scroll compressor of the first embodiment. Referring to FIG. 1, a compression mechanism 1 comprises a fixed scroll 3 having fixed scroll wrap 2, an orbiting scroll 6 having orbiting scroll wrap 4 formed on an orbiting end plate 5 and an oldham ring 8. The fixed scroll 3 is fixed on a sealed container 10 together with a bearing support member 9. An orbiting scroll shaft 7 is mounted on the end plate 5 of the orbiting scroll 6 at the opposite surface to the orbiting scroll wrap 4. The orbiting scroll shaft 7 is inserted in an eccentrically bored bearing hole 13 formed on an end part of the crank shaft 12 with a slide bush 13B which is rotatably borne by an upper bearing support 9 which also serves as a partition member and a lower bearing 11 which is located at a lower part of the sealed container 10. A rotor 15 of an electric motor 16 is fixed to the crank shaft 12 and disposed rotably between the bearing members 9 and 11. A stator 14 of the electric motor 16 is fixed to the sealed container 10 via the bearing support/partition member 9.

The crank shaft 12 is rotated by rotation of the electric motor 16, and the eccentrically bored bearing hole 13 of the crank shaft 12 performs eccentric motion. Since the motion of the orbiting scroll member 6 is guided by the oldham ring 8, the orbiting scroll member 6 performs orbiting motion such that the an orbiting radius is a distance between the axis of the crank shaft 12 and the axis of the orbiting scroll shaft 7. Low-pressure refrigerant gas is sucked from an intake 19 communicated to an intake pipe 18 of the sealed container 10 into plural compression chambers 17. The compression chambers 17 are formed by combining the orbiting scroll wrap 4 with the fixed scroll wrap 2 in the state that either one of the orbiting scroll wrap 4 and the fixed scroll 2 is rotated by 180 degrees from the other. The low-pressure refrigerant gas (coolant) is continuously compressed in the compression chambers 17. The compressed high-pressure refrigerant gas is reserved to a delivery chamber 29 of the sealed container 10 from an outlet 20 disposed on the compression mechanism 1. In the compressor of the present invention, gas to be compressed is not limited to the refrigerant gas, but air or other kinds of gas such as carbon dioxide can be compressed.

The inner space of the sealed container 10 is divided into an upper part which includes the delivery chamber 29, the outlet 20 and the scroll compressor and an electric motor chamber 30 enclosing the electric motor 16 by the compression mechanism 1. A cover 1A is disposed on the surface having the outlet 20 of the compression mechanism 1. The upper openings of the outlet 20 and a communication hole 21 are covered by the cover 1A thereby forming a discharge chamber 29A. The discharge chamber 29A is isolated from the delivery chamber 29 and is communicated to the electric motor chamber 30 by the communication hole 21 formed in the compression mechanism 1. Therefore, the high-pressure refrigerant gas discharged from the outlet 20 flows into the electric motor chamber 30 through the communication hole 21.

A flat vertical cut part 22 is formed on the circumference surface of the stator 14 of the electric motor 16 as shown in FIG. 1, thereby defining a vertical passway between the inside face of the sealed container 10 and the vertical cut part. The main stream of the high-pressure refrigerant gas passes through a vertical space formed between the vertical cut part 22 and the inner wall of the sealed container 10, and reaches the lower part of the sealed container 10 as shown by downward arrows. Then, the most part of the stream of the high-pressure refrigerant gas passes in a space under the stator 14 rightwards in FIG. 1 and further upwards through a vertical gap between the stator 14 and the rotor 15. Subsequently, the high-pressure refrigerant gas passes through a delivery gas passage 35 upwards and is finally delivered outward of the sealed container 10 through a delivery pipe 23.

A known lubricating oil pump 24 is mounted on a lower end of the crank shaft 12. The lubricating oil pump 24 pumps up lubricating oil of an oil receiver 25 mounted on the bottom of the sealed container 10 by rotation of the crank shaft 12. The lubricating oil is sent to the compression mechanism 1 through a communication hole 26 formed in the central part of the crank shaft 12. A part of the lubricating oil passed through the sliding parts of the compression mechanism 1 is discharged to the discharge chamber 29A from the outlet 20 together with the high-pressure refrigerant gas, and the most part of the remaining lubricating oil is discharged in an oil collection pan 27 through an oil return trough 12A formed on an upper part of the crank shaft 12. A small chamber 38 is established by a member which is semicircular on the horizontal section in FIG. 1 and is vertically attached on the side wall of the oil collection pan 27. The lower end of the member is sealed and the upper end thereof is communicated to the discharge oil passage 36. The lubricating oil in the oil collection pan 27 is stirred by rotation of a balance weight 37 mounted on the crank shaft 12, and a centrifugal force is given to the lubricating oil. The lubricating oil is moved to the small chamber through a communication hole 28 of the oil collection pan 27, and flows upward in the small chamber 38. Subsequently, the lubricating oil flows in the discharge oil passage 36 formed in the bearing member 9 of the compression mechanism 1, and is discharged to the same position as the vertical cut part 22 of the stator 14.

Though there is a narrow gap 27A between the oil collection pan 27 and the crank shaft 12, the lubricating oil does not leak from the opening 27A to the rotor 15, because the lubricating oil is moved to the vertical wall of the oil collection pan 27 by the centrifugal force. Therefore, scattering of the lubricating oil by the rotation of the rotor 15 is prevented.

On the other hand, the vertical cut part 22 is formed on the substantially same axial direction as the communication hole 21 of the high-pressure refrigerant gas disposed in the compression mechanism 1 in the vertical direction in FIG. 1. Therefore, the lubricating oil discharged from the discharge oil passage 36 is drawn by the stream of the high-pressure refrigerant gas directed downward in FIG. 1, and flows downward in the sealed container 10 through the vertical cut part 22.

In this process, since the lubricating oil makes many contacts onto the inner wall of the sealed container 10 and the stator 14, droplets of the lubricating oil are formed on the surfaces of the inner wall of the sealed container 10 and the stator 14 by effect of a surface tension. The droplets rapidly falls downward in the sealed container 10 by gravitation and the stream of the high-pressure refrigerant gas. Consequently, the greater part of the lubricating oil returns to the oil receiver 25 on the bottom of the sealed container 10. Remaining part of the lubricating oil included in the stream of the high-pressure refrigerant gas contacts the stator 14 and the rotor 15 and is splashed by the rotation of the rotor and collides against the stator 14 while the stream passes through the gap between the stator 14 and the rotor 15. Consequently, the droplets of the lubricating oil are formed by effect of the surface tension and fall downward by the gravitation. Finally, the lubricating oil returns to the oil receiver 25, and the lubricating oil is separated from the high-pressure refrigerant gas.

According to the first embodiment, a part of the lubricating oil supplied to the compression mechanism and the crank shaft 12 is discharged from the outlet 20 of the compression mechanism 1 together with the high-pressure refrigerant gas, and returns to the oil receiver 25 disposed at the lower part of the sealed container 10. On the other hand, the most part of the lubricating oil is temporarily collected in the oil collection pan 27. Subsequently, the lubricating oil joins the stream of the high-pressure refrigerant gas through the discharge oil passage 36 formed in the compression mechanism 1 and returns to the oil receiver 25. Therefore, the lubricating oil discharged from the compression mechanism 1 is hardly scattered by the rotor 15 under the compression mechanism 1. Consequently, the droplets of the lubricating oil captured by the stream of the high-pressure refrigerant gas are greatly reduced at the opening of the delivery gas passage 35 formed in the compression mechanism 1, and the amount of the lubricating oil which is discharged outward of the sealed container 10 can be greatly reduced. Moreover, since the refrigerant gas passes the gap between the stator 14 and the rotor 15, both are efficiently cooled by the refrigerant gas. Consequently, temperature rise of the electric motor 16 is suppressed.

Moreover, in the case that the outlet of the discharge oil passage 36 is spaced apart from the opening of the delivery gas passage 35 by about 90 degrees or more of central angle with respect to the axis of the crank shaft 12 (180 degrees in FIG. 1), a part of the high-pressure refrigerant gas passed through the communication hole 21 of the compression mechanism 1 frequently contacts the inner wall of the sealed container 10, the compression mechanism 1 and the stator 14. Consequently, the droplets of the lubricating oil included in the stream of the refrigerant gas is effectively separated.

[Second embodiment]

Figure 2:
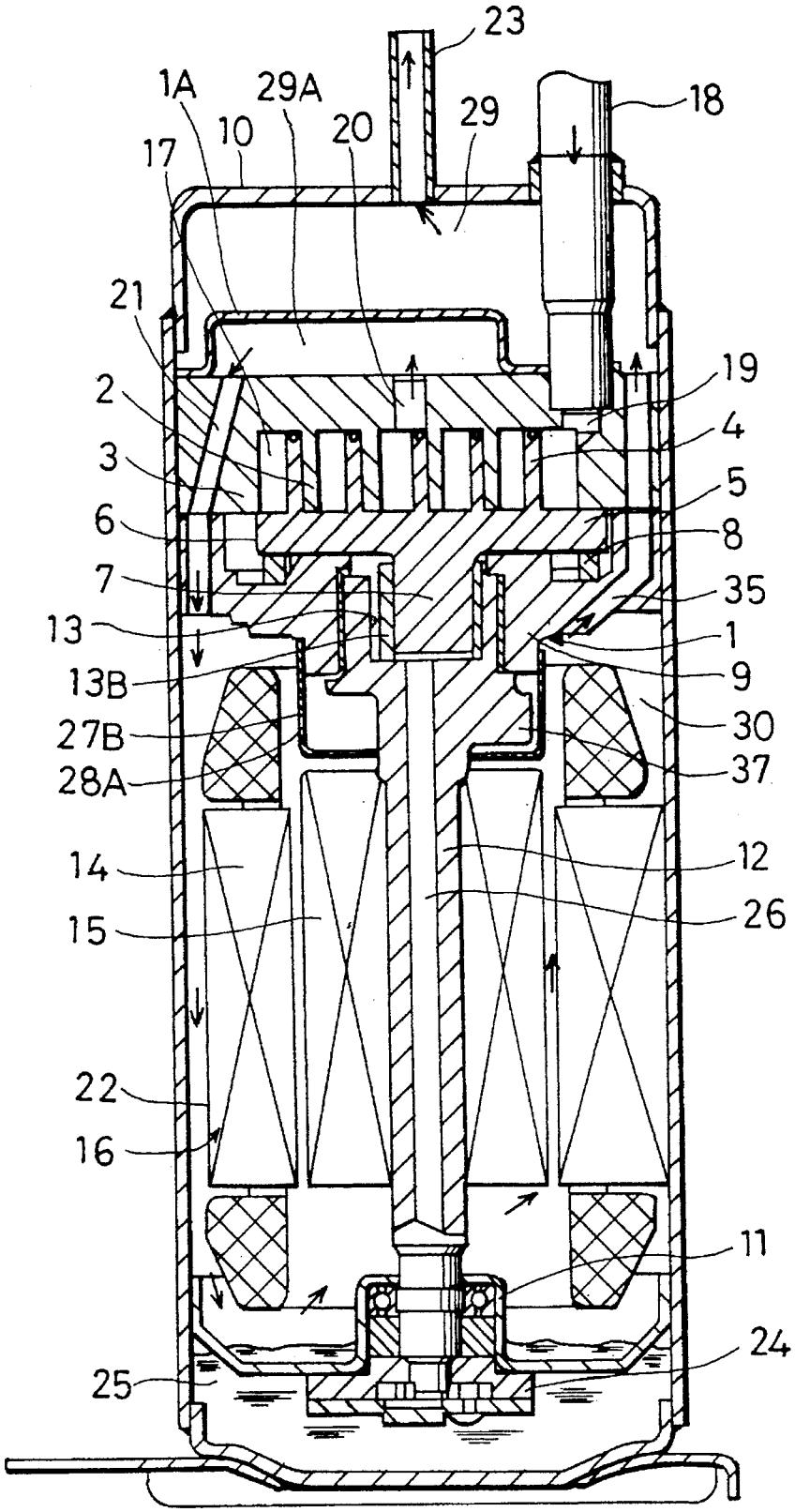
FIG. 2 is a cross-sectional side view of the sealed electric scroll compressor of a second embodiment of the present invention.

FIG. 2 is a cross-sectional side view of the second embodiment of the electric compressor of the present invention. Referring to FIG. 2, an oil collection pan 27A is different from the oil collection pan 27 in FIG. 1, and is not provided with the small chamber 38 in FIG. 1. Instead, a small hole 28A is disposed on the side of the oil collection pan 27B, and the lubricating oil is discharged from the small hole 28A to the stator 14 of the electric motor 16. The remaining components and parts functioning in the same manner as in the arrangement of FIG. 1 are designated by like numerals as used with corresponding parts shown in FIG. 1, and therefore will not be described. The lubricating oil discharged from the small hole 28A collides to the stator 14 of the electric motor 16 and adheres thereto. The adhered lubricating oil becomes droplets by the surface tension, and falls in the gap between the stator 14 and the rotor 15 by the gravitation. Finally, the droplets of the lubricating oil return to the oil receiver 25 placed on the bottom of the sealed container 10.

According to the second embodiment, since the most part of the lubricating oil falls along the stator 14, the lubricating oil adhering to the rotor 15 is reduced. Consequently, the amount of the lubricating oil scattered by rotation of the rotor 15 is also reduced, and the lubricating oil which is undesirably discharged to the refrigerating cycle is greatly reduced.

[Third embodiment]

Figure 3:
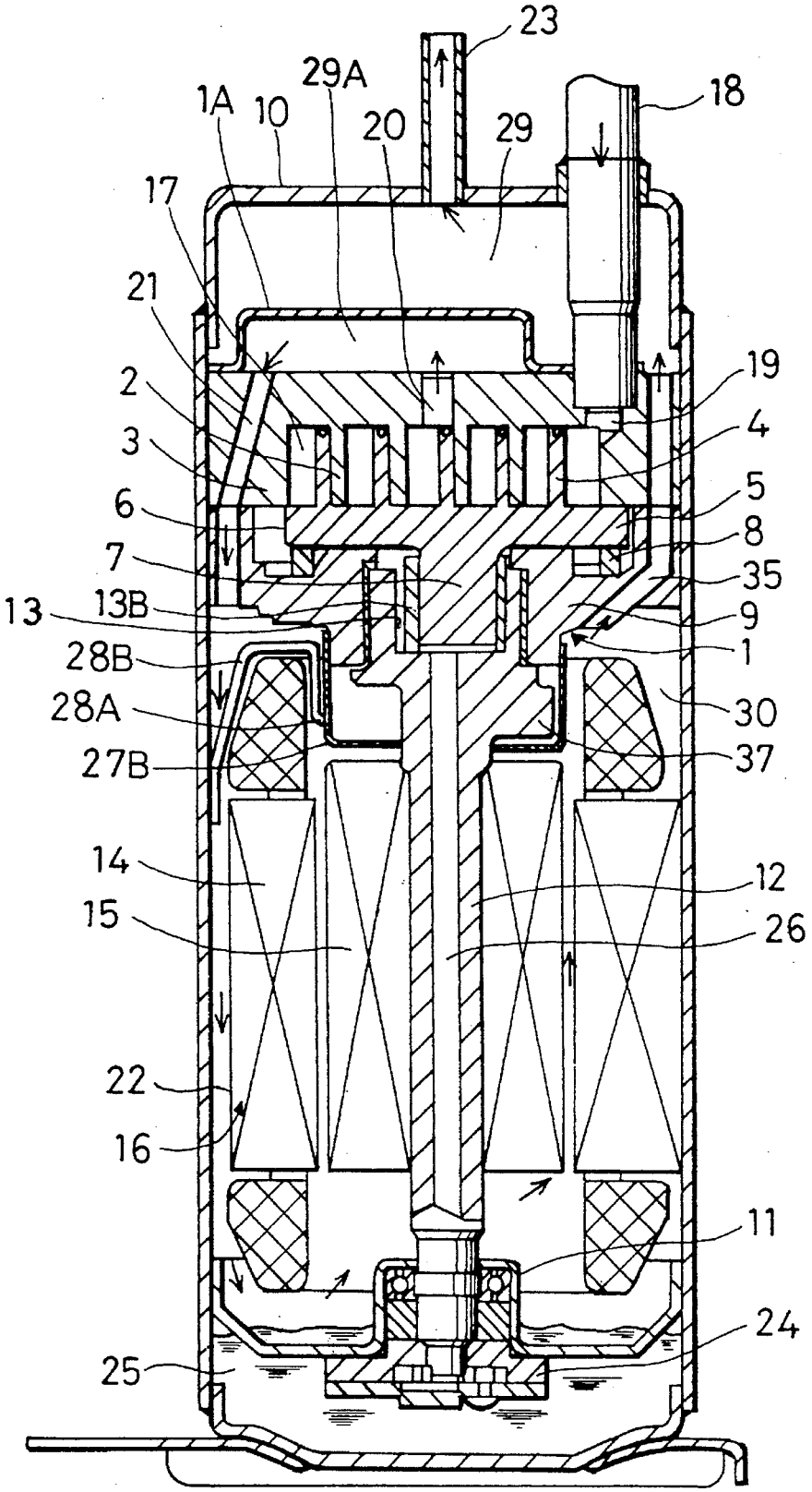
FIG. 3 is a cross-sectional side view of the sealed electric scroll compressor of a third embodiment of the present invention.

FIG. 3 is a cross-sectional side view of the third embodiment of the electric compressor of the present invention. Referring to FIG. 3, an oil discharge tube 28B is coupled to the small hole 28A of the oil collection pan 27B. The remaining components functioning in the same manner as in the arrangement of FIG. 2 are designated by like numerals as used with corresponding parts shown in FIG. 2, and therefore will not be described. The oil discharge tube 28B is led bending along and over the stator 14 so that the lubricating oil of the oil collection pan 27B is discharged from the outlet of the discharge tube 28B adjacent to or correspondent to the vertical cut part 22 formed on the side face of the stator 14. Consequently, the lubricating oil does not adhere on the rotor 15, and the lubricating oil is not scattered by the rotation of the rotor 15. Consequently, the amount of the lubricating oil which is delivered to the refrigerating cycle is further reduced.

The oil collection pan 27B and the oil discharge tube 28B can be made of resin such as engineering plastics. In this case, the fabricating cost is inexpensive. Moreover, in the event that the oil discharge tube 28B contacts the stator 14, malfunction due to short circuit is not liable to occur.

[Fourth embodiment]

Figure 4:
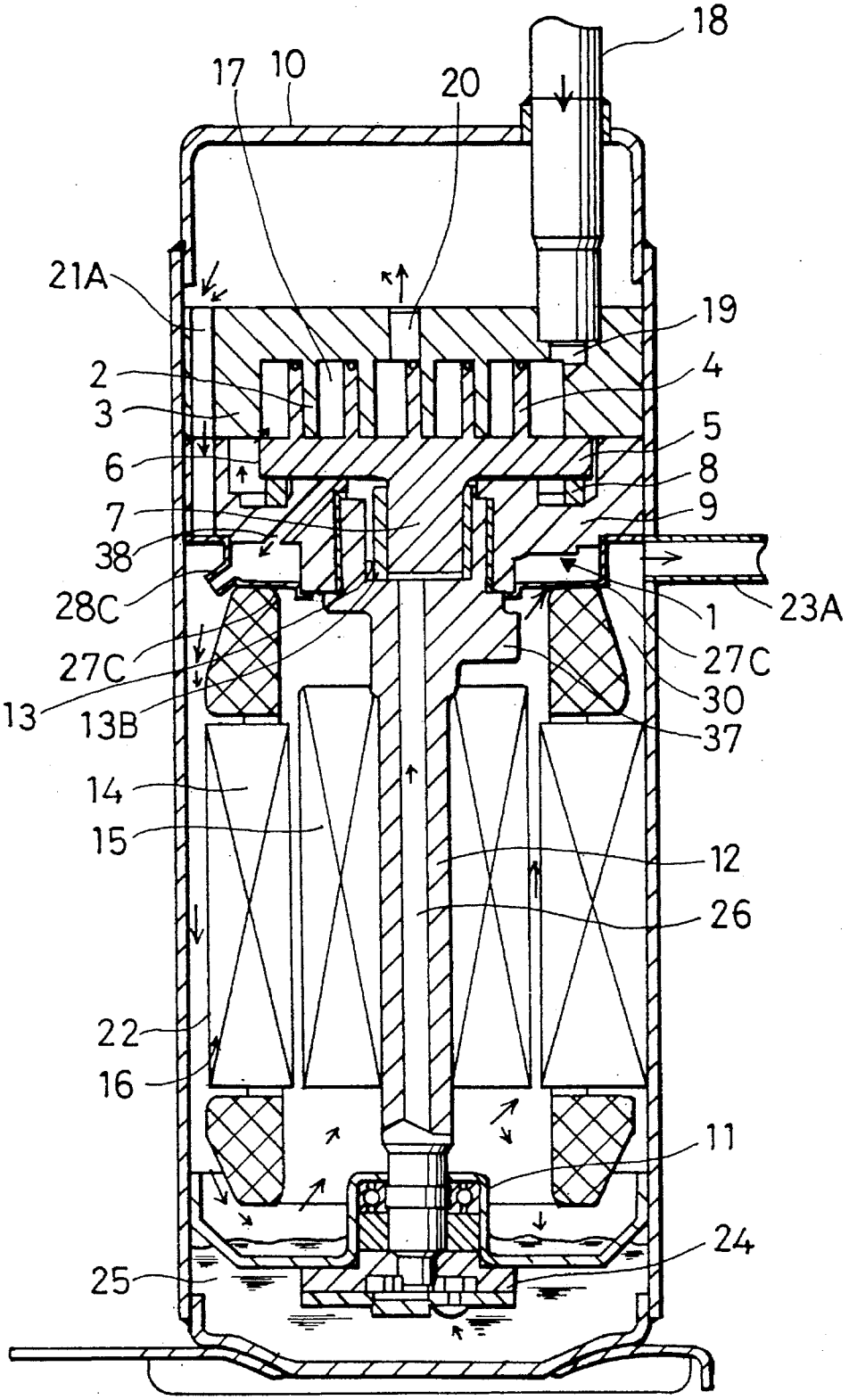
FIG. 4 is a cross-sectional side view of the sealed electric scroll compressor of a fourth embodiment of the present invention.

FIG. 4 is a cross-sectional side view of the fourth embodiment of the electric compressor of the present invention. Referring to FIG. 4, an oil collection pan 27C is disposed under the bearing member 9 of the compression mechanism 1. An oil collection hole 38 is formed in the bearing member 9, and the lubricating oil after lubrication of the compression mechanism 1 is collected in the oil collection pan 27C through the oil collection hole 38. The lubricating oil in the oil collection pan 27C is discharged from the outlet of the discharge tube 28C adjacent to or correspondent to the vertical cut part 22 formed on the side face of the stator 14 through the oil discharge tube 28C.

In the fourth embodiment, a delivery pipe 23A is disposed on the side face of the sealed container 10. On the other hand, the cover 1A in FIG. 3 is not disposed on the compression mechanism 1. Moreover, a communication hole 21A of the compression mechanism 1 is disposed in parallel to the crank shaft 12. The remaining components functioning in the same manner as in the arrangement of FIG. 3 are designated by like numerals as used with corresponding parts shown in FIG. 3, and therefore will not be described. In FIG. 4, short arrows illustrate flowing paths of the lubricating oil and long arrows illustrate flowing paths of the high-pressure refrigerant gas.

According to the fourth embodiment, since the oil collection pan 27C is disposed on the lower surface of the bearing member 9, the bottom of the oil collection pan 27C is located at a position which is higher than an upper surface of the stator 14. Therefore, the lubricating oil collected in the oil collection pan 27C can be guided into the vertical cut part 22 without the use of a long tube having a complicated shape such as the oil discharge tube 28B in FIG. 3 of the third embodiment. Since the opening of the delivery pipe 23A to deliver the high-pressure refrigerant gas outward from the sealed container 10 is remotely located from the outlet 20, the cover 1A is not necessary. Moreover, since the opening of the delivery pipe 23A is spaced apart from the opening of the oil discharge tube 28C, the lubricating oil is not mixed in the stream of the high-pressure refrigerant gas by passing a shorter way. Consequently, the amount of the lubricating oil discharged outward from the sealed container is reduced.

[Fifth embodiment]

Figure 5A:
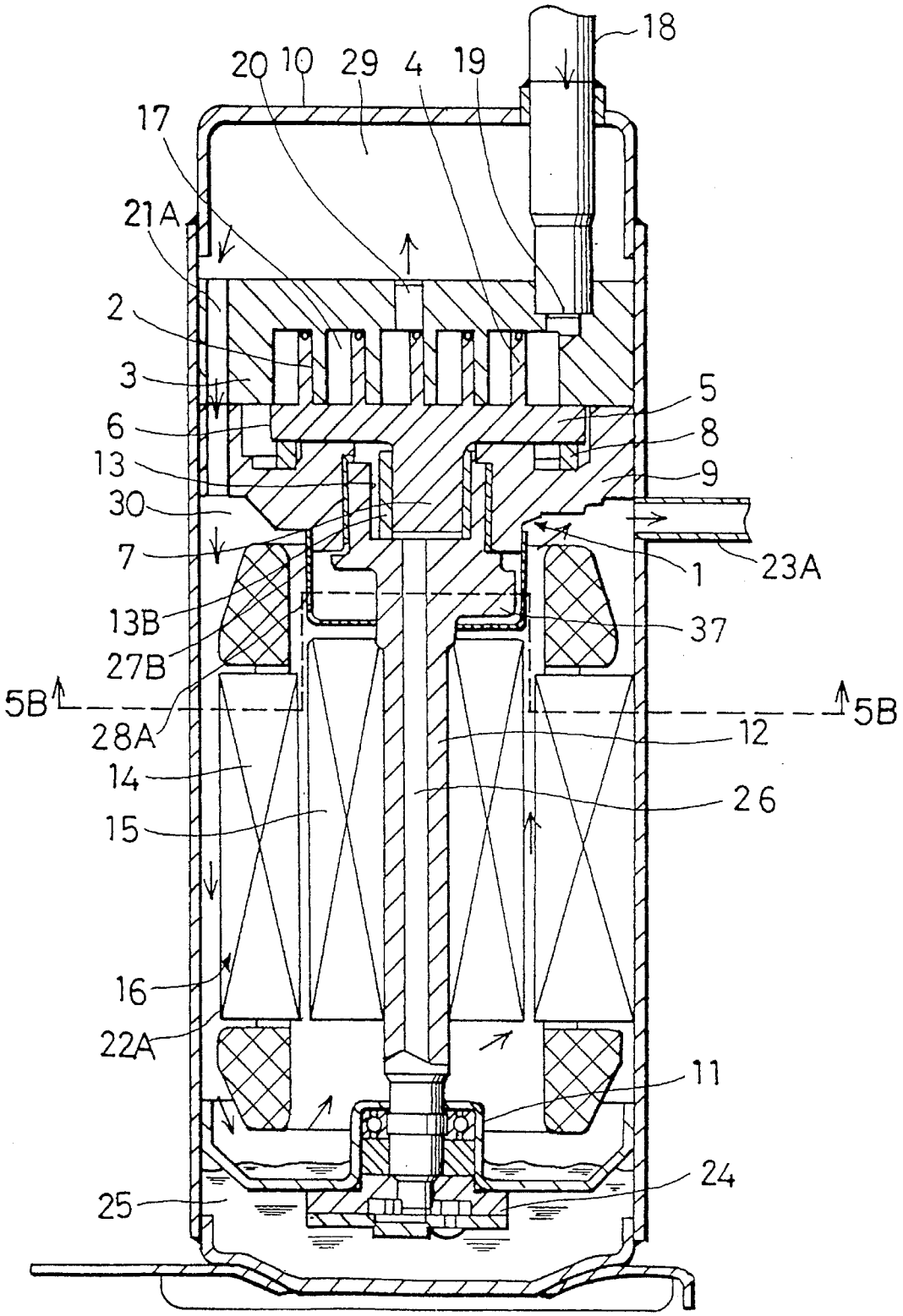
FIG. 5A is a cross-sectional side view of the sealed electric scroll compressor of a fifth embodiment of the present invention.

FIG. 5A is a cross-sectional side view of a fifth embodiment of the electric compressor of the present invention. Referring to FIG. 5A, the compression mechanism 1 is not provided with the cover 1A on the upper surface of the compression mechanism 1 as shown in FIG. 1 of the first embodiment. Moreover, the communication hole 21A of the compression mechanism 1 is disposed in parallel to the crank shaft 12. The delivery pipe 23A is disposed on the side face of the sealed container 10. Therefore, the delivery gas passage 35 for communicating the chambers 29 and 30 in FIG. 1 is not formed in the compression mechanism 1 of FIG. 5A. The structure and the operation of the compression mechanism 1 is substantially similar to the compression mechanism 1 in FIG. 1 except for the above-mentioned elements.

Figure 5B:
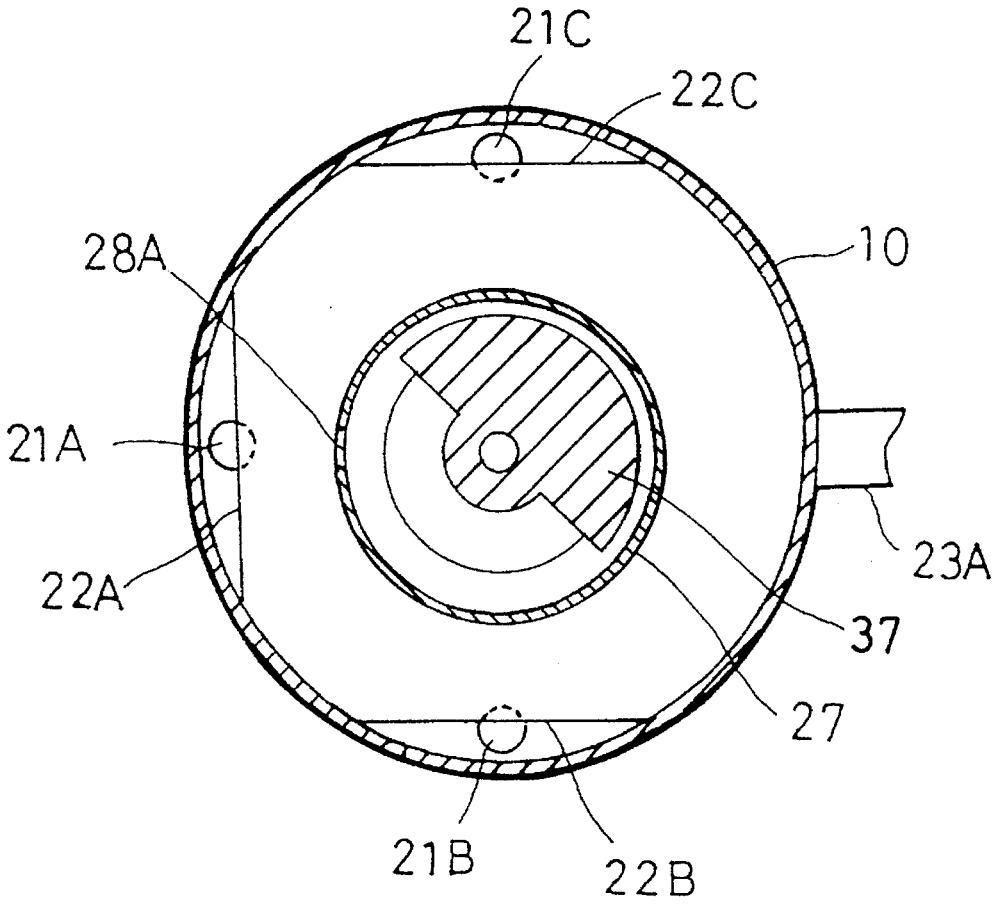
FIG. 5B is a partially schematic horizontal section of FIG. 5A taken along the broken line 5B—5B.

The lubricating oil in the oil receiver 25 on the bottom of the sealed container 10 is pumped to the compression mechanism 1 through the communicating hole 26 disposed in the central part of the crank shaft 12 by the rotation of the crank shaft 12. After the lubrication of the sliding parts of the compression mechanism 1, a part of the lubricating oil is discharged to the delivery chamber 29 from the outlet 20 of the compression mechanism 1 together with the high-pressure refrigerant gas. The most part of the remnant of the lubricating oil is once discharged in the oil collection pan 27B. The lubricating oil collected in the oil collection pan 27B is discharged from the small hole 28A of the oil collection pan 27B which is disposed at the position of about 180 degrees of central angle of the rotation axis of the crank shaft 12 with respect to the delivery pipe 23A mounted on the sealed container 10 as shown in FIG. 5B.

In the fifth embodiment, three vertical spaces formed between the sealed container 10 and three vertical cut parts 22A, 22B and 22C are formed on the circumference of the stator 14. Moreover, three communication holes 21A, 21B and 21C are formed in the compression mechanism 1 at positions corresponding to the vertical cut parts 22A, 22B and 22C, respectively. The high-pressure refrigerant gas discharged from the outlet 20 of the compression mechanism 1 enters the electric motor chamber 30 through these communication holes 21A, 21B and 21C, and reach the part adjacent to the oil receiver 25 by passing through the vertical cut parts 22A, 22B and 22C. Then, the high-pressure refrigerant gas passes through a gap between the stator 14 and the rotor 15 via the lower bearing member 11 and is delivered to the delivery pipe 23A.

As mentioned above, since the distance of a route through which the high-pressure refrigerant gas passes is long between the outlet 20 and the delivery pipe 23A to deliver outward from the sealed container 10, the flow velocity of the high-pressure refrigerant gas is sufficiently lowered. Moreover, since the high-pressure refrigerant gas contacts the inner wall surface of the sealed container 10 and the stator 14 or the like during a long period, the lubricating oil included in the stream of the high-pressure refrigerant gas becomes droplets on the surface of the inner wall of the sealed container 10 and the stator 14 by the surface tension. Consequently, the lubricating oil falls downward in the sealed container 10 by the gravitation, and returns to the lubricating oil receiver 25 on the bottom of the sealed container 10. Therefore, the lubricating oil is almost separated from the high-pressure refrigerant gas.

Since the route of the lubricating oil which falls from the small hole 28A of the oil collection pan 27B is different from the routes of the main streams of the high-pressure refrigerant gas in the electric motor chamber 30, the lubricating oil falling from the small hole 28A is hardly captured by the main streams of the high-pressure refrigerant gas. Consequently, the lubricating oil is hardly included in the stream of the high-pressure refrigerant gas which is finally delivered outward from the sealed container 10.

Moreover, since the high-pressure refrigerant gas flows through three routes on the electric motor 16 as mentioned above, the electric motor 16 is sufficiently cooled by the high-pressure refrigerant gas. The number of the vertical cut parts 22A, 22B and 22C is not limited to three as shown in FIG. 5B, an arbitrary number of vertical cut parts, four, five or six for example, can be formed on the stator 14.

[Sixth embodiment]

Figure 6:
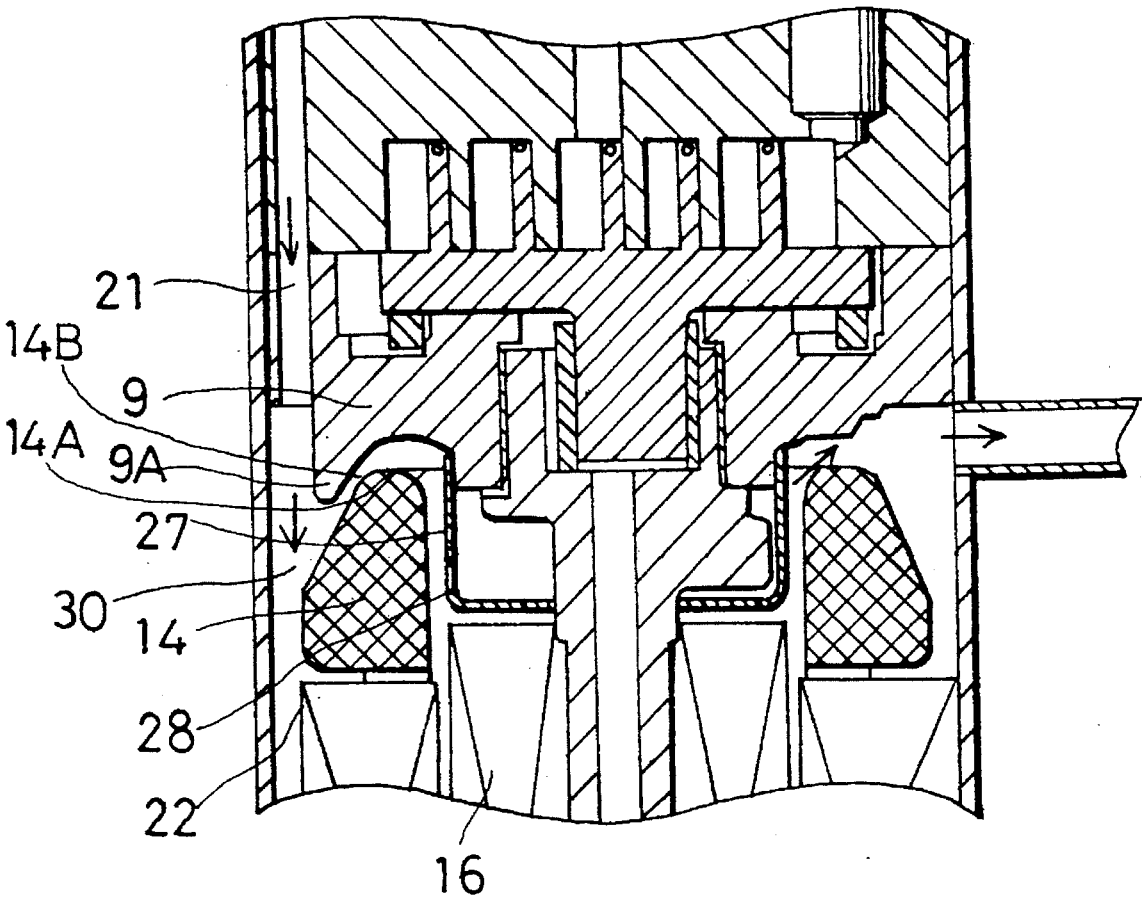
FIG. 6 is a relevant part of the cross-sectional side view of the sealed electric scroll compressor of a sixth embodiment of the present invention.

FIG. 6 is a cross-sectional side view illustrating a relevant part of the sixth embodiment of the sealed electric compressor of the present invention. Referring to FIG. 6, the height of the end tip of the protruded part 9A on the circumferential portion of the bearing member 9 is set lower than the height of the upper end 14A of the stator 14 of the electric motor 16, and both overlap with a gap 14B. Consequently, the main stream of the high-pressure refrigerant gas flowing into the electric motor chamber 30 through the communication hole 21 easily flows into the vertical cut part 22 formed on the stator 14. Therefore, further improvement is realizable in the separation of the lubricating oil from the high-pressure refrigerant gas and a cooling effect in the electric motor 16.

[Seventh embodiment]

Figure 7:
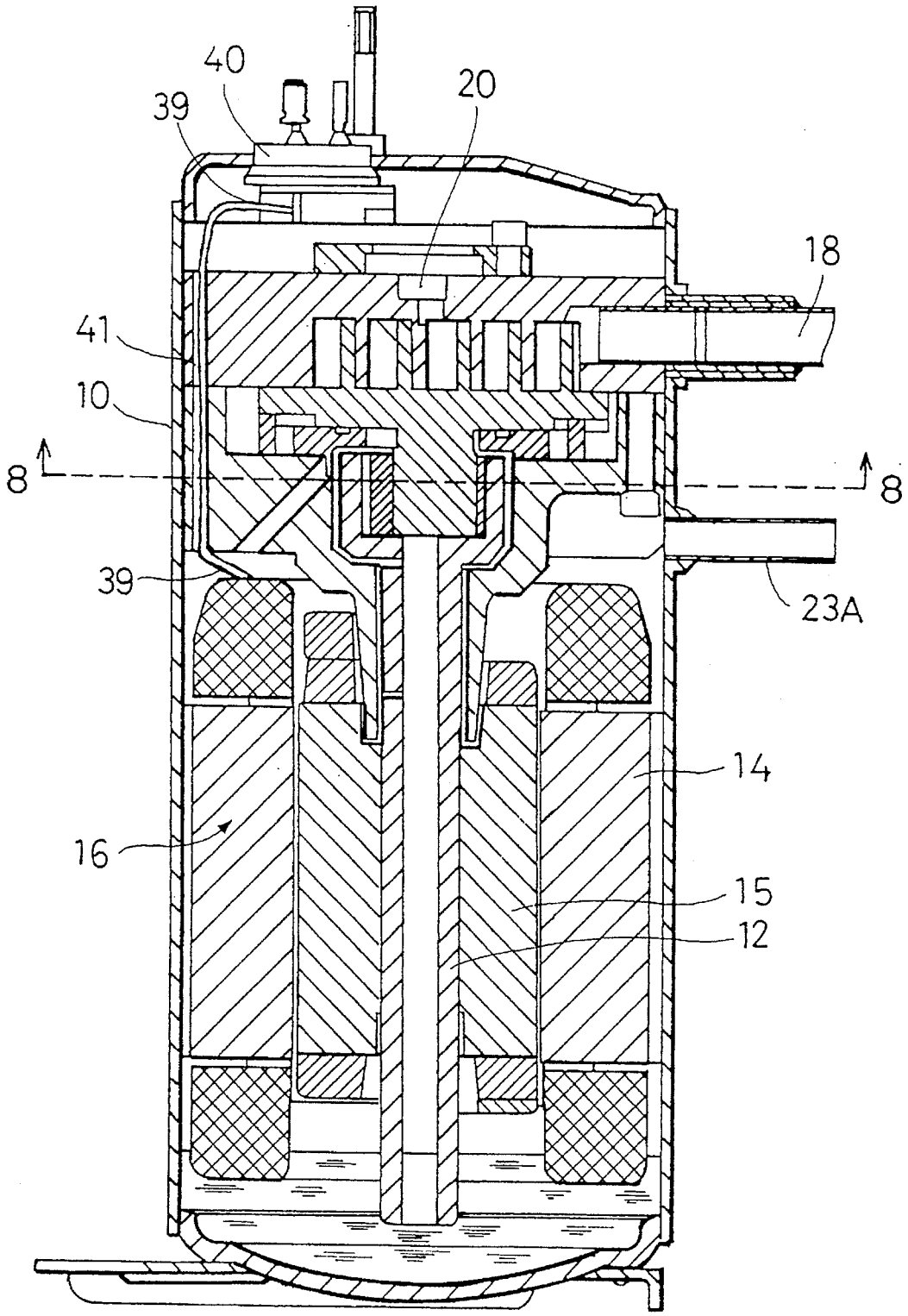
FIG. 7 is a cross-sectional side view of the sealed electric scroll compressor of a seventh embodiment of the present invention.
Figure 10:
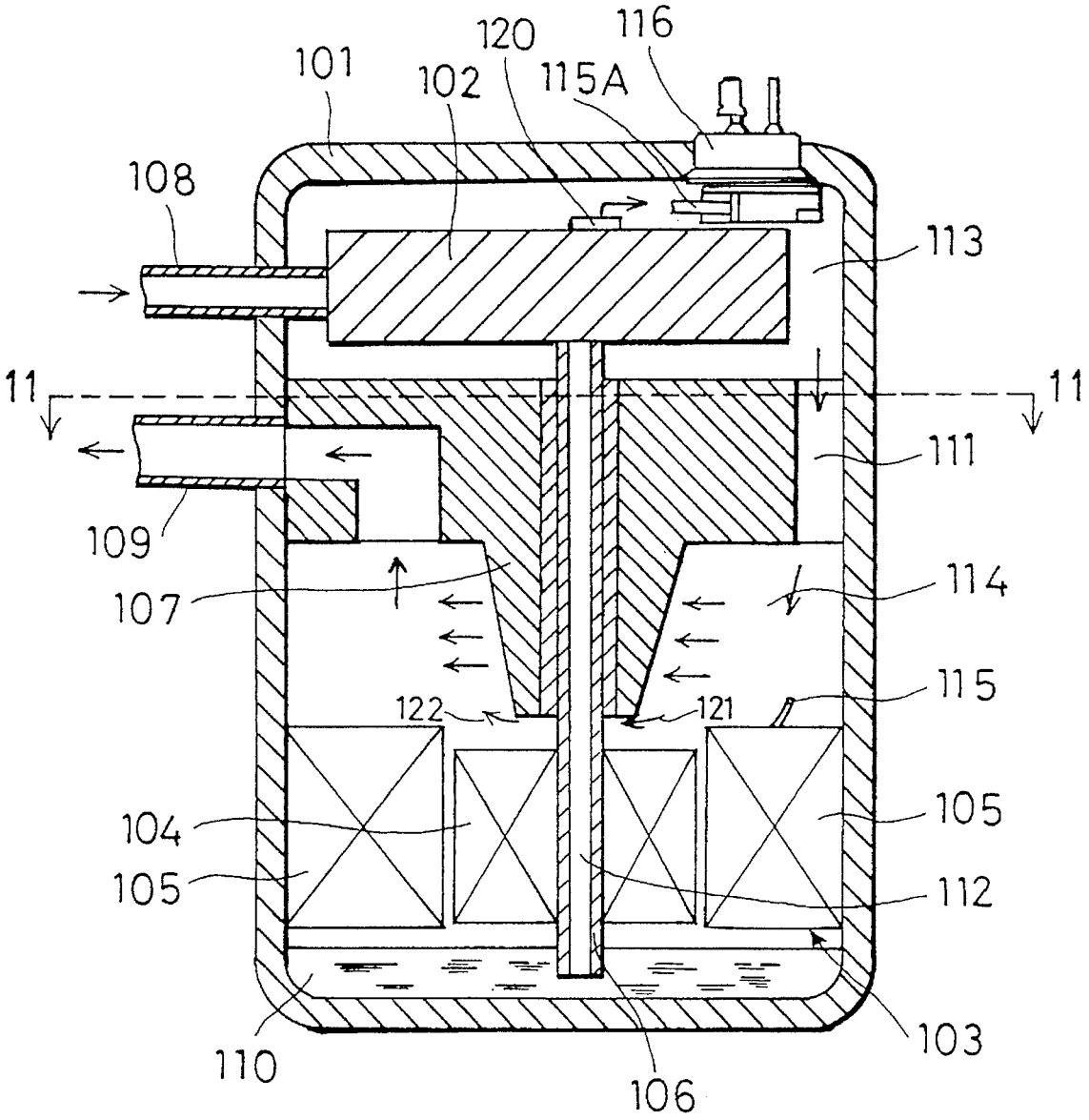
FIG. 10 (Prior Art)
FIG. 10 is a cross-sectional side view of the sealed electric scroll compressor in the prior art.
Figure 11:
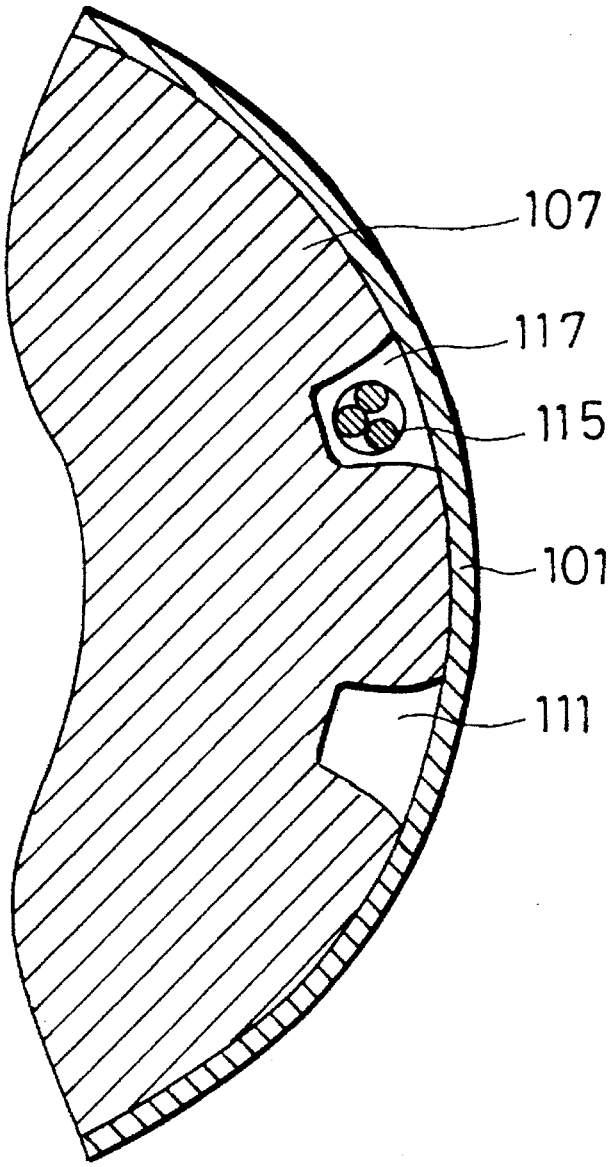
FIG. 11 (Prior Art)
FIG. 11 is a partially schematic horizontal section of FIG. 10 taken along the broken line 11—11.

FIG. 7 is a cross-sectional side view of the seventh embodiment of the sealed electric compressor of the present invention. Referring to FIG. 7, the configuration of an intake pipe 18 and a delivery pipe 23 are different from those of the first embodiment. Basic configurations of the compression mechanism 1 and the electric motor 16 disposed in the sealed container 10 are substantially similar to those of the first embodiment as shown in FIG. 10.

Figure 8:
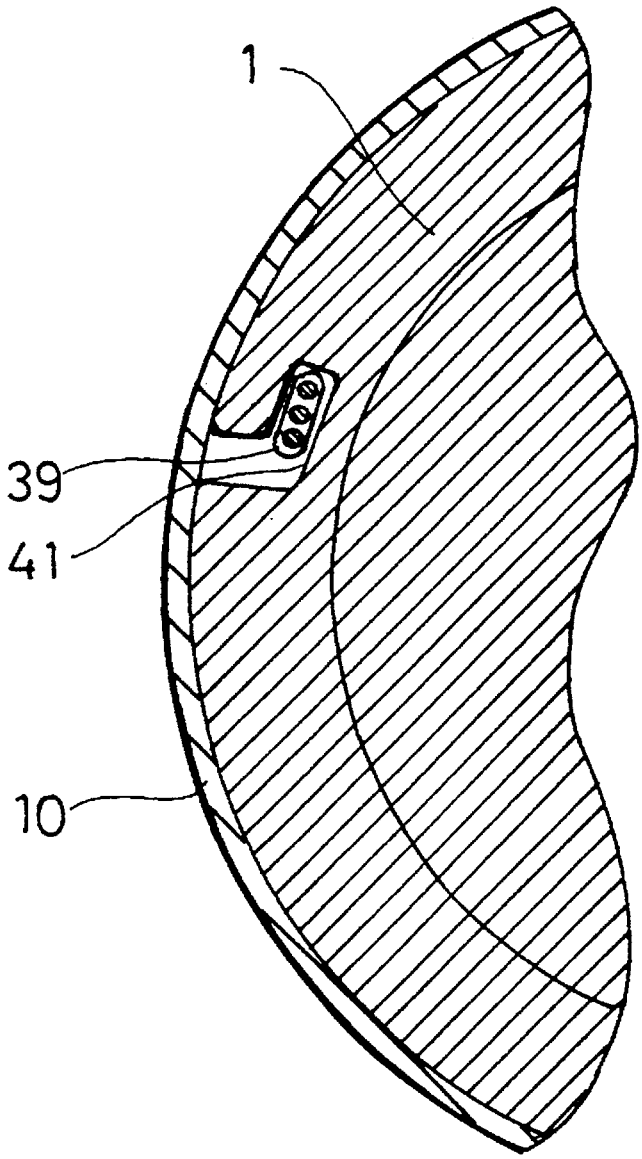
FIG. 8 is a partially schematic horizontal section of FIG. 7 taken along the broken line 8—8.

In the seventh embodiment, a long cavity 41 is formed in parallel to the crank shaft 12 on the side face of the compression mechanism 1. The cross-sectional view of the cavity 41 is illustrated in FIG. 8 which is a partially schematic horizontal section of FIG. 7 taken along the broken line B—B. As shown in FIG. 8, the cavity 41 is formed on the side face of the compression mechanism 1 in the direction of the central axis by a predetermined depth and is bent along the circumference thereof. The cross-sectional shape of the cavity 41 is of L-letter shape. Lead wires 39 connecting between the sealed terminal 40 and the electric motor 16 (in FIG. 7) are inserted in the cavity 41. The sealed container 10 is heated to a high temperature in the welding process of fabrication. The lead wires 39 are spaced apart from the inner wall of the sealed container 10 and are prevented to contact thereto by inserting in the cavity 41. Consequently, the insulating layers of the lead wires 39 do not sustain damage by heating.

[Eighth embodiment]

Figure 9A:
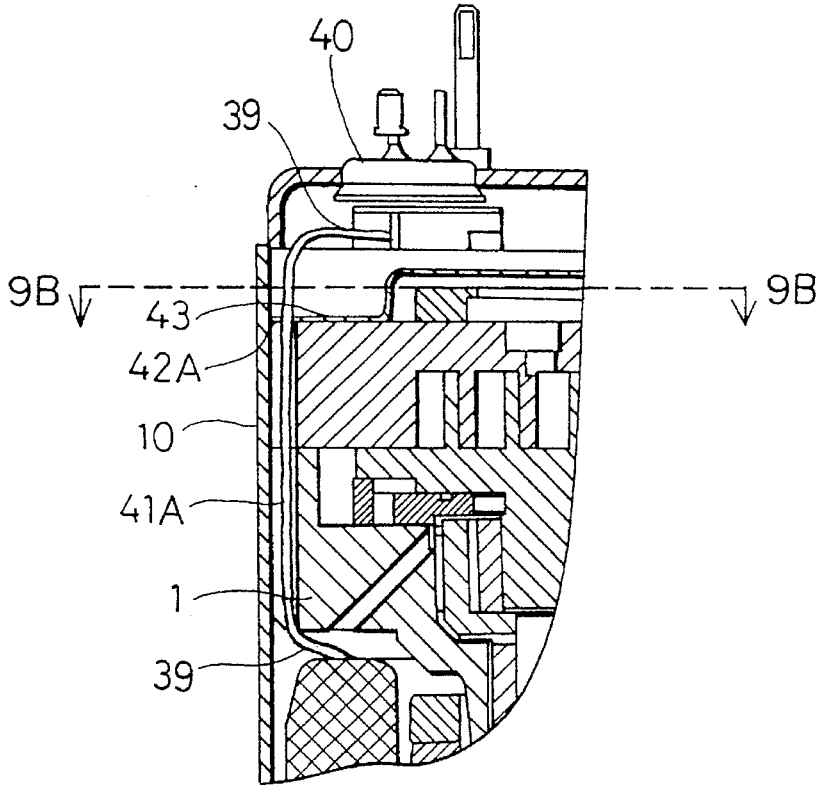
FIG. 9A is a relevant part of a cross-sectional side view of the sealed electric scroll compressor of an eighth embodiment of the present invention.
Figure 9B:
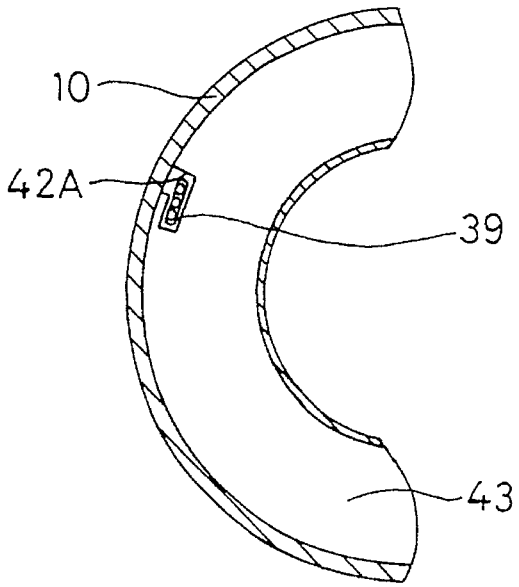
FIG. 9B is a partially schematic horizontal section of FIG. 9A taken along the broken line 9B—9B.

FIG. 9A is a cross-sectional side view of a relevant part of the eighth embodiment of the sealed electric compressor of the present invention. In the eighth embodiment, a L-letter-shaped recess 42A is formed in a cover 43 disposed on the upper part of the compression mechanism 1. On the other hand, a trough vertical space 41A is formed on the side face of the compression mechanism 1. The lead wires 39 are inserted in the trough vertical space 41A and the recess 42A by giving a predetermined tension as shown in FIG. 9B. Consequently, the lead wires 39 are spaced apart from the inner wall of the sealed container 10. In the eighth embodiment, a machining process to form the trough vertical space 41A of the compression mechanism 1 is simplified in comparison with the forming of the cavity 41 in the seventh embodiment as shown in FIG. 7. The lead wires 39 of the stator 14 of the electric motor 16 are connected to a sealed terminal 40 disposed on the upper part of the sealed container 10 through the recess 42A. Consequently, the lead wires 39 are not severely influenced by the heat in the welding process of the sealed container 10, and the deterioration or melt of the insulating layer of the lead wires 39 can be prevented.

Incidentally, in the above-mentioned embodiments, the descriptions are made by taking the example of the sealed electric scroll compressor, but the present invention is applicable to other sealed electric compressor such as a sealed rotary compressor.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. A compressor comprising:

compression means disposed in a sealed container for compressing gas, intake means for taking said gas into said compression means, an electric motor disposed in said sealed container for driving said compression means, a crank shaft disposed in said sealed container for transmitting a driving torque of said electric motor to said compression means, discharge means disposed at a part of said compression means for passing said gas out of said sealed container, a bearing support member having first and second sides in which a bearing for supporting said crank shaft is located, the compression means being located on the first side of the bearing support member, a separate, enclosed oil collection pan located on the second side of the bearing support member around said crank shaft for temporarily collecting lubricating oil after lubrication of said compression means and said crank shaft, and an oil passage means provided in said collection pan for passing oil therefrom.

2. A compressor in accordance with claim 1, wherein said oil collection pan contains first and second chambers, and a communication hole is provided between the first and second chambers.

3. A compressor in accordance with claim 1 wherein an eccentric weight for balancing rotation of said crank shaft is provided in said oil collection pan located around said crank shaft.

4. A compressor in accordance with claim 6 wherein at least one of said oil collection pan for collecting lubricating oil and said tube connected to said oil pan is made of plastic.

5. A compressor comprising:

a compression means disposed in a sealed container for compressing gas, intake means for taking said gas into said compression means, an electric motor disposed in said sealed container for driving said compression means, a crank shaft disposed in said sealed container for transmitting a driving torque of said electric motor to said compression means, discharge means disposed at a part of said compression means for passing said gas out of said sealed container, a bearing support member having first and second sides in which a bearing for supporting said crank shaft is located, the compression means being located on the first side of the bearing support member, a separate, enclosed oil collecting pan for temporarily collecting lubricating oil after lubrication of said compression means and said crank shaft located on the second side of the support member, and oil passage means disposed on a circumference of said oil collecting pan for discharging collected oil from said oil collecting pan.

6. A compressor comprising:

a compression means disposed in a sealed container for compressing gas, intake means for taking said gas into said compression means, an electric motor disposed in a motor chamber of said sealed container, and having a stator and a rotor for driving said compression means, a crank shaft disposed in said sealed container for transmitting a driving torque of said electric motor to said compression means, discharge means for passing gas out of said sealed container, disposed at a lower part of said compression means, a bearing support member having first and second sides in which a bearing for supporting said crank shaft is located, the compression means being located on the first side of the bearing support member, an oil collection pan located on the second side of the bearing support member around the crank shaft for temporarily collecting lubricating oil after lubrication of said compression means and said crank shaft, and a tube mounted on said oil collection pan for discharging the collected lubrication oil in said sealed container.

7. A compressor in accordance with claim 6, wherein an outlet of said tube is disposed in alignment with a vertical cut part formed on a circumference of said stator of said electric motor.

8. A compressor in accordance with claim 6, wherein the tube includes an outlet which is radially disposed about 90 degrees or more apart from said discharge means with respect to a central axis of said crank shaft.

9. A sealed electric compressor in accordance with claim 6, wherein a circumferential edge of said compression mechanism located in said electric motor chamber overlaps a circumferential edge of the stator with a gap.

10. A sealed electric compressor comprising:

a compression mechanism disposed in a sealed container for compressing refrigerant gas, refrigerant gas intake means for taking said refrigerant gas into said compression mechanism, an electric motor having a stator and a rotor disposed in said sealed container for driving said compression mechanism, a crank shaft having a communication hole along an axis thereof and disposed in said sealed container for transmitting a driving torque of said electric motor to said compression mechanism, an interior space of the sealed container being divided by the compression mechanism into an electric motor chamber containing said electric motor and a delivery outlet chamber having a discharge outlet from said compression mechanism, a bearing support member having first and second sides located between the compression mechanism and the electric motor chamber, the compression mechanism being located on the first side of the bearing support member, and the electric motor being located on the second side of the bearing support member, a lubricating oil receiver disposed on a lower part of said sealed container, an oil collection pan having at least one small hole and disposed between said compression mechanism and said electric motor on the second side of the bearing support member for temporarily collecting lubricating oil after moving parts of said compression mechanism are lubricated by said lubricating oil supplied from said lubricating oil receiver through said communication hole of said crank shaft, a hole in fluid communication between said delivery outlet chamber and said electric motor chamber through which high pressure refrigerant gas discharged from said discharge outlet passes, a first vertical path defined between an inner wall of said sealed container and a vertical cut part located along substantially the same vertical axis as an axis of said hole in fluid communication with the electric motor chamber, the first vertical cut part being located on a circumference of the stator of said electric motor, a main stream of the high pressure refrigerant flowing from the hole and through the first vertical path; and at least one other vertical path defined between the inner wall of said sealed container and at least one other vertical cut part on the circumference of said stator, such that said main stream passes through a gap between said stator and said rotor and the at least one other vertical path and is delivered out of said sealed container from a delivery pipe positioned radially approximately 180 degrees apart from said small hole with respect to the crank shaft axis.

11. A sealed electric compressor comprising:

a compression mechanism disposed in a sealed container for compressing refrigerant gas, intake means for taking said refrigerant gas into said compression mechanism, an electric motor disposed in said sealed container for driving said compression mechanism, a crank shaft disposed in said sealed container for transmitting a driving torque of said electric motor to said compression mechanism, a lubricating oil receiver disposed on a lower part of said sealed container, an oil collection pan having at least one small hole and being disposed between said compression mechanism and said electric motor for temporarily collecting lubricating oil after moving parts of said compression mechanism are lubricated by lubricating oil supplied from said lubricating oil receiver through said communication hole of said crank shaft, an interior space of said sealed container is partitioned into an electric motor chamber, containing said electric motor, and a delivery chamber, having a discharge outlet from said compression mechanism, by said compression mechanism, a bearing support member having first and second sides located between the compression mechanism and the electric motor chamber, the compression mechanism being located on the first side of the bearing support member, and the oil collection pan being located on the second side of the bearing support member, and a communication hole for communicating between said electric motor chamber and said delivery chamber located in said compression mechanism, such that the communication hole is positioned at substantially the same radial direction as the central angle of said small hole disposed on said oil collection pan with respect to a rotation axis of said crank shaft.

12. A sealed electric compressor comprising:

a compression mechanism disposed in a sealed container for compressing refrigerant gas, refrigerant gas intake means for taking said refrigerant gas into said compression means, an electric motor having a stator and a rotor disposed in said sealed container for driving said compression mechanism, a crank shaft having a communication hole along the axis thereof and disposed in said sealed container for transmitting a driving torque of said electric motor to said compression mechanism, a lubricating oil receiver disposed on a lower part of said sealed container, an oil collection pan having at least one small hole, said oil collection pan being disposed for temporarily collecting lubricating oil after moving parts of said compression mechanism are lubricated by said lubricating oil supplied from said lubricating oil receiver through said communication hole of said crank shaft, said compression mechanism partitions and divides an interior space of said sealed container into an electric motor chamber containing said electric motor and a delivery outlet chamber having a discharge outlet of said compression mechanism, a bearing support member having first and second sides in which a bearing for supporting said crank shaft is located, said bearing support member being located between the compression mechanism and the electric motor chamber, the compression mechanism being located on the first side of the bearing support member and the oil collection pan being located on the second side of the bearing support member, and communication hole means for communication between said delivery outlet chamber and said electric motor chamber through which high pressure refrigerant gas discharged from said delivery chamber passes, a first vertical path formed between an inner wall of said sealed container and a vertical cut part located along substantially the same vertical axis as an axis of said communication hole means on a circumference of the stator of said electric motor, the main stream of high pressure refrigerant gas flows through the first vertical path, and at least one other vertical path formed between the inner wall of said sealed container and at least one other vertical cut part on the circumference of said stator, said main stream passes through a gap between said stator and said rotor and the at least one other vertical path and said main stream is delivered out of said sealed container from a delivery pipe positioned radially approximately 180 degrees apart from said small hole with respect to a central axis of the crank shaft.

13. A sealed electric compressor comprising:

a compression mechanism disposed in a sealed container for compressing refrigerant gas, an electric motor having a stator and a rotor disposed in said sealed container for driving said compression mechanism, refrigerant gas intake means for taking said refrigerant gas into said compression mechanism, a crank shaft disposed in said sealed container for transmitting a torque of said electric motor to said compression mechanism, a lubricating oil receiver disposed on a lower part of said sealed container, a bearing support member having first and second sides in which a bearing for supporting said crank shaft is located, said bearing support member being located between the compression mechanism and the electric motor chamber, the compression mechanism being located on the first side of the bearing support member and the oil collection pan being located on the second side of the bearing support member, an oil collection pan having at least one small hole, said compression mechanism partitions and divides an interior space of said sealed container into an electric motor chamber containing said electric motor and a delivery chamber having a discharge outlet of said compression mechanism, and communication hole means through which high pressure refrigerant gas discharged from said discharge outlet to said delivery chamber passes for communication between said delivery chamber and said electric motor chamber, said communication hole being positioned at substantially the same radial location as said small hole.

* * * * *